United States Patent [19]

Fry et al.

[11] Patent Number: 4,724,563

[45] Date of Patent: Feb. 16, 1988

[54] PERSONAL CARE POWER BRUSH

[76] Inventors: Raymond A. Fry, 2550 Pecho Valley Rd., Los Osos, Calif. 93402; Arlo Crownoble, 2223 Finch La., San Diego, Calif. 92123

[21] Appl. No.: 852,837

[22] Filed: Apr. 16, 1986

[51] Int. Cl.[4] ..... A46B 13/02

[52] U.S. Cl. ..... 15/28

[58] Field of Search ..... 15/22 R, 23, 24, 28, 15/29, 97 R; 320/2

[56] References Cited

U.S. PATENT DOCUMENTS

| | | | |
|---|---|---|---|
| 2,678,457 | 1/1950 | Demo et al. . | |
| 3,417,417 | 4/1966 | Rhodes . | |
| 3,699,952 | 10/1972 | Waters et al. . | |
| 3,757,419 | 9/1973 | Hopkins . | |
| 3,864,780 | 2/1975 | Watkins . | |
| 3,932,909 | 1/1976 | Johnson et al. . | |
| 3,939,599 | 2/1976 | Henry | 15/28 |
| 4,137,588 | 2/1979 | Sandt et al. . | |
| 4,158,246 | 6/1979 | Meadows et al. . | |
| 4,397,056 | 8/1983 | Miller . | |

FOREIGN PATENT DOCUMENTS

| | | | |
|---|---|---|---|
| 3341465 | 5/1985 | Fed. Rep. of Germany | 15/28 |
| 414971 | 7/1947 | Italy | 15/28 |
| 452961 | 9/1936 | United Kingdom | 15/28 |

OTHER PUBLICATIONS

Black & Decker owner's manual for "Scrub Brusher", Model 9385; Cordless Scrubber; pp. 1 and 7.

*Primary Examiner*—Edward L. Roberts

*Attorney, Agent, or Firm*—Kerkam, Stowell, Kondracki & Clarke

[57] ABSTRACT

A personal care powered scrub brush apparatus and recharging arrangement that uses a waterproof housing. The scrub brush apparatus is specially shaped to allow one to easily use the device and allow proper seating within a recharging cradle having contours which mate with the periphery of a head portion of the apparatus. The recharging cradle uses contacts which are spring-biased by the leaf spring operation of the contacts themselves in order to assure proper electrical contact for recharging of batteries within the scrub brush apparatus. The cradle further includes a floor slanted to a drip tube which allows water to flow to a removable basin such that the scrub brush may be placed upon the cradle for recharging with the brush in place and without waiting for the brush to dry.

20 Claims, 8 Drawing Figures

4
24
90
90R
RECHARGE SOURCE 84

90L
86
78N
92
78P
116P
116S
116S
94
26
4
14
12
10
24
32

90L
88
90B
114L
84N
86B
94
92
96
110L
26
90BN
104
116S
98
106
102
100

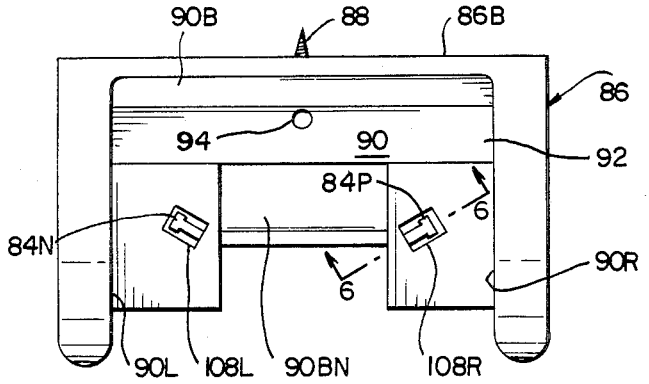
FIG 5
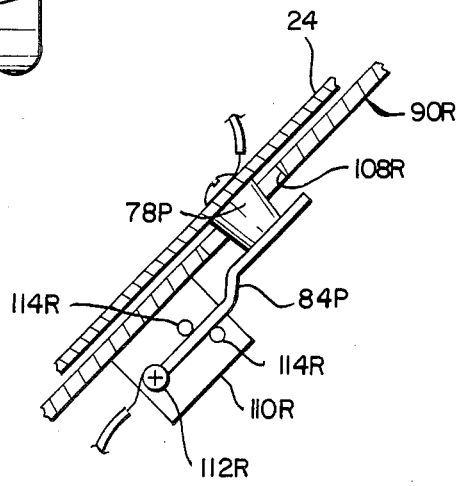
FIG 6
FIG 7
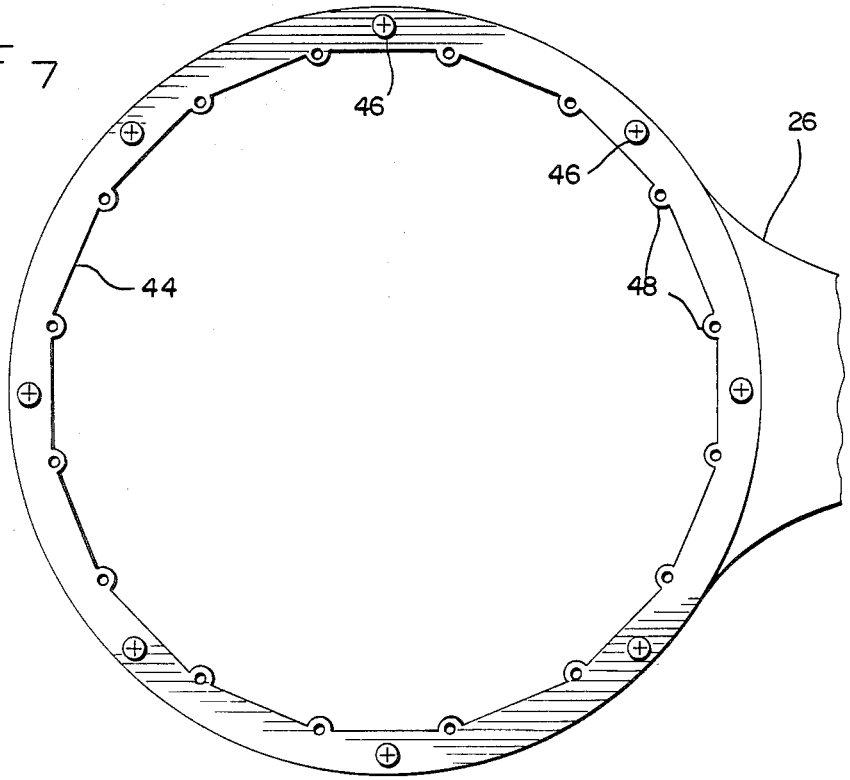

PERSONAL CARE POWER BRUSH

BACKGROUND OF THE INVENTION

This invention relates to a personal care power brush. More specifically, this invention relates to a battery powered power brush for scrubbing oneself in the shower, bathtub, or over a sink.

The use of various scrub brushes is generally known. When taking a bath or shower, people often use a scrub brush with a relatively long handle in order to scrub their back.

In addition to the back-scrubbing type of brushes, various powered scrub brushes have heretofore been used. The design of such brushes has varied tremendously depending upon the function (i.e., personal hygiene, washing a car or any of numerous other functions) for which the brush is intended.

The following patents show various prior brushes:

| Patent No. | Inventor | Date of Issuance |
|---|---|---|
| 2,678,457 | Demo | May 18, 1954 |
| 3,417,417 | Rhodes | December 24, 1968 |
| 3,699,952 | Waters | October 24, 1972 |
| 3,757,419 | Hopkins | September 11, 1973 |
| 3,864,780 | Watkins | February 11, 1975 |
| 3,932,909 | Johnson | January 20, 1976 |
| 4,089,079 | Nicholson | May 16, 1978 |
| 4,137,588 | Sandt | February 6, 1979 |
| 4,158,246 | Meadows | June 19, 1979 |
| 4,397,056 | Miller | August 9, 1983 |

The Demo and Nicholson patents both disclose water-powered personal brushes.

The Rhodes shows a scrubbing device which is mountable upon a holder attached to a wall.

The Waters patent shows a battery operated rechargeable scrubber.

The Hopkins patent shows a portable rechargeable tooth cleaner.

The Watkins patent shows a cleaning brush which has an arrangement to allow fluid flow out through the brush.

The Johnson patent shows a scrub brush which is self-powered and has an arched neck portion.

The Sandt patent shows a portable cleansing device with a brush and having a holder for recharging the device.

The Meadows patent shows a cordless scrubber which uses rechargeable batteries.

The Miller patent shows a toilet brush which is driven by rechargeable batteries.

Although the above and other prior brushes have been generally useful, numerous of the prior scrubbers have been subject to one or more of several disadvantages.

Prior power personal scrubbers have often been complex in construction leading to high cost of manufacture and/or excessive breakdowns. Scrubbers which are not water-proof have been quite limited in application. Powered scrubbers which are designed for personal hygiene have often been shaped or sized such that it is impossible or quite difficult to thoroughly clean one's back with them. Scrubbers which have recharging holders often require removal of the scrub brush prior to placement of the device in the holder. Further, such prior recharging scrubbers may necessitate plugging or unplugging the scrubber into the holder as opposed to simply placing it on the holder. That is, it may require an inconvenient amount of precision to place it in proper charging position. Prior scrubbers may also use holders which are damaged by water dripping from the scrubber onto the holder. Such dripping water may additionally damage the floor or anything else disposed underneath the holder.

OBJECTS AND SUMMARY OF THE INVENTION

Accordingly, it is a primary object of the present invention to provide a new and improved personal scrub brush apparatus.

A further object of the present invention is to provide a new and improved cradle or holder for a scrub brush apparatus.

A more specific object of the present invention is to provide a scrub brush apparatus which is advantageously shaped to allow one to use powered scrubbing on one's back.

Another object of the present invention is to provide a scrub brush apparatus cooperating with a recharging cradle for easy placement and removal of the apparatus on the cradle.

Yet another object to the present invention is to provide a cradle for a scrub brush apparatus having an arrangement to avoid damage to the cradle caused by dripping water.

The above and other objects of the present invention including the avoidance and/or minimizing of the discussed problems with the prior art scrubbers are realized by a personal scrub brush apparatus including: a housing having a handle portion and a head portion; a battery compartment for holding at least one battery within the housing; a rotatable scrub brush having bristles thereon and mounted at the head portion; a motor mounted in the housing, drivingly connected to rotate the scrub brush, and electrically connected to operate under the power from one or more batteries in the battery compartment; and a switch mounted on the handle portion and operable to switch power to the motor. The handle portion includes a front and a back, the front of the handle portion being closest to the brush and extending in a straight line. The scrub brush is disposed in a plane which intersects the front of the handle portion at an obtuse angle, and the housing further includes a neck portion connecting the head portion to the handle portion, the neck portion having a narrower width at an end adjacent the handle portion and increasing in width closer to the head portion. The handle portion is a handle member and the neck portion is a distinct member fastened thereto and extending along a convex back surface. The switch is on the front of the handle, the battery compartment is in the handle, and the motor is in the head portion. The housing further includes a shield extending peripherally around the scrub brush.

The present invention may alternately be described as a personal scrub brush apparatus including: a housing having a handle portion and a head portion; a battery compartment for holding at least one battery within the housing; a rotatable scrub brush having bristles thereon and mounted at the head portion; a motor mounted in the housing, drivingly connected to rotate the scrub brush, and electrically connected to operate under the power from one or more batteries in the battery compartment; and a switch mounted on the handle portion and operable to switch power to the member; and first and second charging contacts mounted on opposite sides of the head portion and connected to provide recharging energy to the battery compartment for recharging a battery or batteries disposed therein; and wherein the head portion is wider than the handle portion and is adapted to seat within a recharging cradle having first and second source contacts which respectively contact the first and second charging contacts when the head portion is seated in the cradle. A charge indicator light is mounted on the housing and is operable to light when recharging is occurring. The invention further comprises a recharging cradle for supporting the apparatus and having a head accommodating portion to removeably receive the head portion, the head accommodating portion having first and second source contacts mounted therein and connected to a recharging source. The first and second source contacts are biased to properly contact the respective first and second charging contacts. The first and second source contacts each function as a leaf spring to maintain proper contacts respectively with the first and second charge contacts. The head accommodating portion includes a floor slanted away from the first and second charging contacts. The head accommodating portion is adapted to receive the head portion with the scrub brush mounted thereon and the cradle further comprises a water collection basin disposed to receive water dripping from the scrub brush when the apparatus is in the cradle.

The present invention may alternately be described as a personal scrub brush apparatus including: a housing having a handle portion and a head portion; a battery compartment for holding at least one battery within the housing; a rotatable scrub brush having bristles thereon and mounted at the head portion; a motor mounted in the housing, drivingly connected to rotate the scrub brush, and electrically connected to operate under the power from one or more batteries in the battery compartment; and a switch mounted on the handle portion and operable to switch power to the motor; and the invention further comprises a cradle for supporting the apparatus and having a head accommodating portion adapted to removably receive the head portion with the scrub brush mounted thereon and a water collection basin adapted to receive water dripping from the scrub brush when the apparatus is in the cradle. The cradle includes a back for placement against a wall and the head accommodating portion has a floor portion slanted downwardly towards the back and the cradle further includes a passageway for allowing water passage from the floor to the basin. The floor portion is further slanted downwardly towards a center of the floor portion. The basin is slideably mounted to the cradle. The handle portion extends below the cradle when the head portion is seated in the cradle. The cradle has first and second source contacts and the head portion is wider than the handle portion and is adapted to sit in the cradle with the first and second source contacts respectively contacting first and second charging contacts on the housing when the head portion is seated in the cradle.

BRIEF DESCRIPTION OF THE DRAWINGS

The above and other features of the present invention will be more readily understood when the following detailed description is considered in conjunction with the accompaning drawings wherein like characters represent like parts throughout the several views and in which:

FIG. 5 shows a top view of the holder.

FIG. 6 shows a partial simplified cross section view along 6—6 of FIG. 5 and showing parts of the apparatus and holder of the present invention.

FIG. 7 shows a seal as used with the present invention.

DETAILED DESCRIPTION

Figure 1:
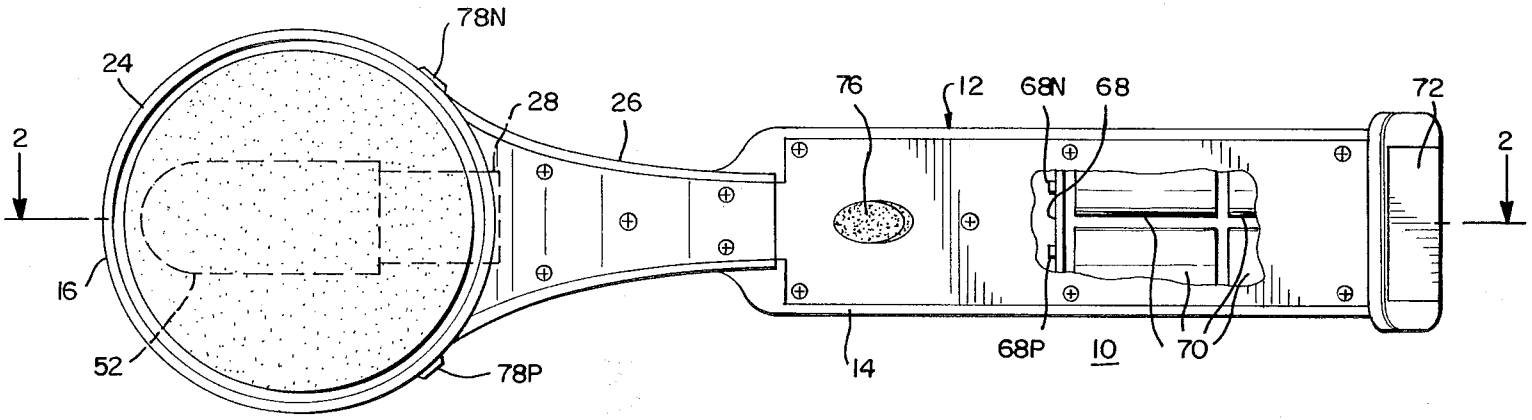
FIG. 1 shows a front view of the personal scrub brush apparatus of the present invention.
Figure 2:
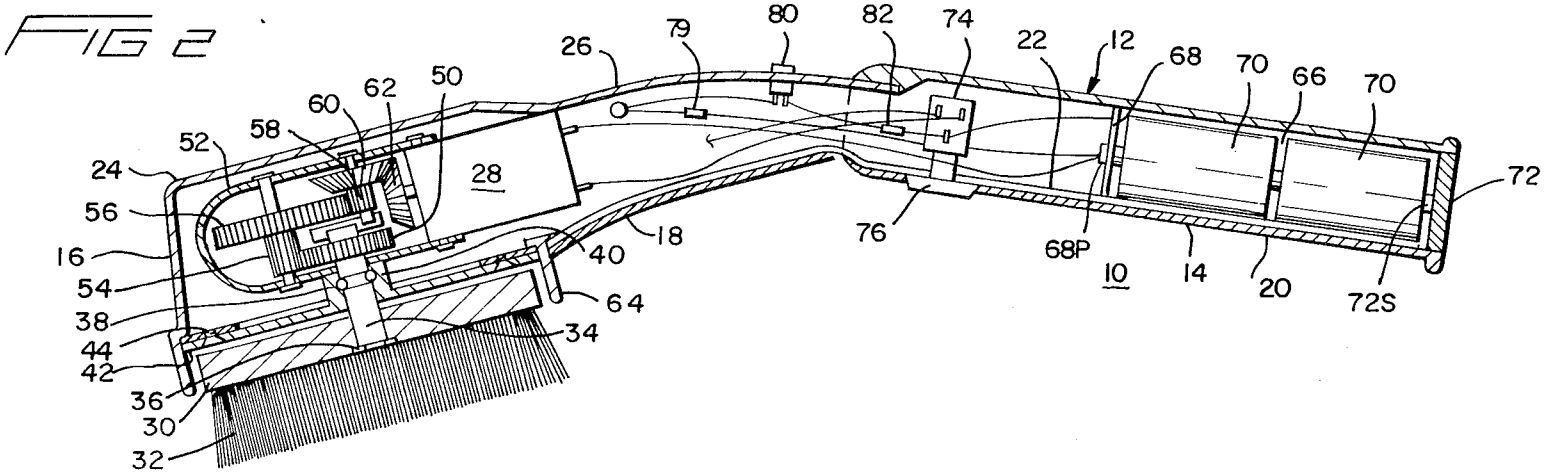
FIG. 2 shows a cross section view of the apparatus of FIG. 1 taken along lines 2—2 except that not all of the internal components in the apparatus have been sectioned.

With reference now to FIGS. 1 and 2, the scrub brush apparatus 10 according to the present invention will be discussed in detail. The apparatus 10 includes a housing 12 made of first and second members 14 and 16. The housing 12 is water proof to minimize the chances of water damaging the components within the interior of the housing 12. The member 16 includes a plastic outer case 18 which attaches within the plastic outer case 20 of the member 14. The case 18 is screwed, glued, or simply snapped within the case 20, there also being a rubber plate seal 22 extending within the casings 18 and 20. The casings 18 and 20 are preferably made of ⅛ inch thick high impact plastic. The rubber seal 22 may include small 1/16 inch holes which fit over 1/16 inch seal pins (not shown) in order to maintain the seal 22 in place.

As shown, the handle member 14 serves as a handle portion, whereas the member 16 includes a head portion 24 connected to the handle portion by way of a neck portion 26.

The head portion 24 has a motor 28 disposed therein and powering a scrub brush with having a head 30 with soft bristles 32 suitable for application against human skin. The brush head 30 is mounted to a ⅜ inch by 1 11/16 stainless steel spindle 34. The brush head 30 is held to the spindle 34 by a lock washer 36 and a phillips head machine screw (not visible), both of which are made of stainless steel to avoid being damaged from water. A rubber O-ring 38 is used to seal around the spindle 34, although a spring-loaded seal could alternately be used. The spindle 34 fits within a spindle bushing 40, which bushing is made of nylon and includes a ⅛ inch thick plate 42. A rubber seal 44 is inside of plate 42 and, with momentary reference to FIG. 7, includes a number of screw holes 46 extending therethrough and allowing one to screw the plate 42 to inwardly extending flanges (not shown) from the sides of the head portion 24. Additionally, the seal 44 includes a number of holes 48 used for accommodating seal pins extending up from the plate 42 and used for holding the seal 44 in position.

The spindle 34 is driven by a forty point gear 50 which is one of several gears disposed within a nylon gear housing 52. The forty point gear 50 will provide 375 rpm to the brush 30 as a result of the gearing arrangement reducing the 9000 rpm of the motor 28. The gear 50 is connected to a ten point gear 54 which provides 1500 rpm upon rotation of the sixty point gear 56 which is driven by the ten point gear 58. The ten point gear 58 is driven by the pinions 60 and 62.

The casing 24 includes a shield portion 64 extending around the brush head 30 such that entanglement of hair or other objects within the spindle 34 may be avoided during the rotation of the brush under power from the motor 28. The shield portion 64 extends in a circle around the circular brush head 30.

The handle member or portion 14 includes a battery compartment 66 bounded at one end by a wall 68 and, in the preferred embodiment, adapted to hold four 1½ volt batteries arranged in series to produce six volts across positive and negative terminals 68P and 68N respectively. In the preferred embodiment, the batteries 70 may be inserted through a removable plate 72 having a conductive strap 72S mounted thereon for completing the series arrangement of the batteries. The plate 72 may be hinged or otherwise removable from the casing 12.

Continuing to view FIGS. 1 and 2, but also making reference to the electrical schematic diagram of FIG. 8, the electrical connections used with the present invention will be discussed. For ease of illustration, the batteries 70 have been shown as a single six volt battery in FIG. 8.

A micro push-push (i.e., single push changes it to the opposite state, whereas a second push changes its state back to the original state, either open or closed) switch 74 is mounted under a flexible rubber seal 76 which allows operation of the switch by use of one's thumb upon the front of the handle 14, the front of the handle 14 being that surface closest to the brush 30. The switch 74 alternately connects the negative terminal 68N to a negative terminal 28N of motor 28 or to a charging terminal 78N located on the periphery of the head portion 24. A similarly constructed positive charging contact 78P is located on the opposite side of the head portion 24 and is connected to the positive battery terminal 68P by way of diode 79 used to insure that current may flow only from charge contact 78P to battery terminal 68P and to block reverse current. The charge terminal 78P is also connected to the battery terminal 68N by way of light 80 and the preferably 222 kilohms ¼ watt resistor 82 used for proper control of voltage to the recharge indicator light 80. The charger 84 preferably has an input of 120 volts a.c. 60 hz. 5 watts and an output of 5.8 volts AC 123 ma.

Figure 8:
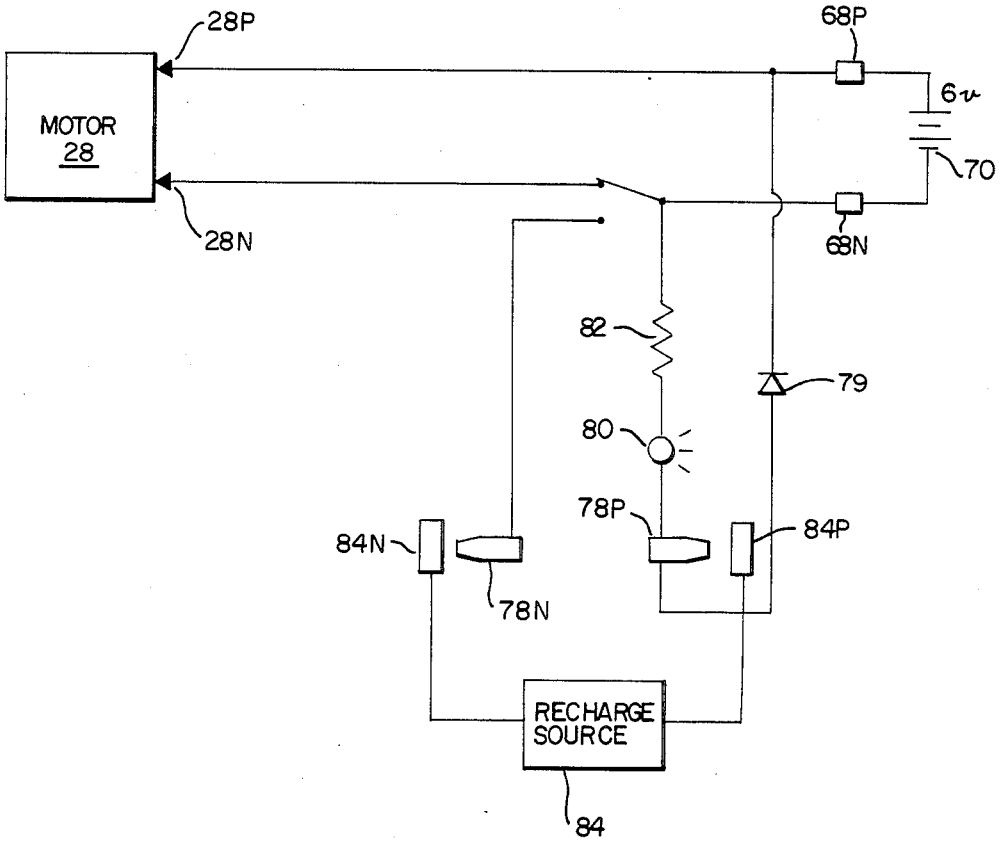
FIG. 8 is a schematic of the electrical system of the present invention.

When the two way micro switch 74 is in the position illustrated in FIG. 8, power will flow from the batteries 70 to turn the motor 28 and in turn operate the scrub brush. When the micro switch 74 is in the alternate position source contacts 84P and 84N of a recharge source 84 may be respectively connected to charging contacts 78P and 78N to provide recharging for the batteries 70 whereupon indicator light 80 will light to show that recharging is taking place. If desired, sockets 116S (FIG. 3 and FIG. 4 only) may be mounted on both sides of the cradle such that a plug 116P (FIG. 3 only) may plug the source 84 into cradle 86 from either side of the cradle.

Figures 3, 4:
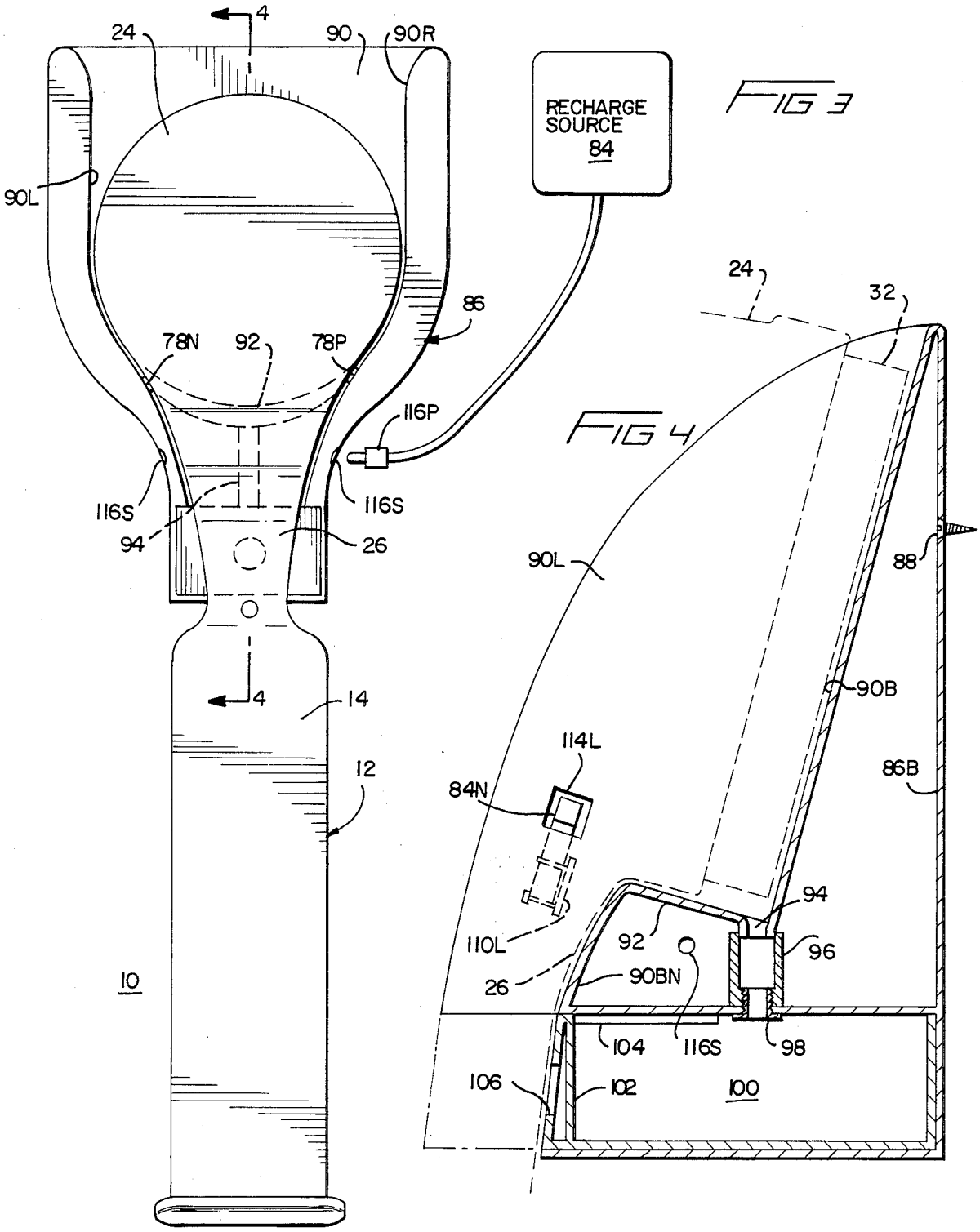
FIG. 3 shows a back view of the brush apparatus as mounted upon a holder.
FIG. 4 shows a cross section view of the holder taken along lines 4—4 of FIG. 3.

With reference now to FIGS. 3, 4, and 5, a recharging cradle 86 will be discussed. The recharging cradle 86 is adapted to seat the scrub brush apparatus 10 and allow recharging thereof. In particular, the apparatus 10 may seat within the cradle 86 in the manner shown in FIG. 3 and illustrated by the phantom lines for head portion 24, neck portion 26, and bristles 32 in FIG. 4. With momentary reference back to FIG. 2, the shape of the apparatus 10 is especially well suited for seating upon the cradle 86 by virtue of the convex front and back surfaces along the neck portion 26 such that the front (corresponding to numeral 20 in FIG. 2) extends in a straight line and the scrub brush 30 is disposed in a plane which intersects the front of the handle portion 14 at an obtuse angle. Additionally, the neck portion 26 is narrower at its end adjacent the handle portion 14 and increases in width closer to the head portion 24. This shape is useful not only for proper placement within the cradle 86, but is highly advantageous for a person's use upon his or her back when taking a shower or bath.

The cradle 86 has a back surface 86B which can be mounted upon a wall by one or more screws 88 (FIGS. 3 and 5). The cradle 86 has a head accommodating zone or portion 90 defined by a steeply (i.e., more than 60° relative to horizontal) inclined back wall 90B, right and left side walls 90R and 90L. A floor 92 is inclined or slanted downwardly towards the back of the cradle and is circularly curved so as to be concentric with the circular curve of the bristles 32 when the apparatus 10 is disposed within the cradle. A neck back portion 90BN is curved steeply down to accommodate the neck 26 of the apparatus 10.

The floor 92 has a hole 94 centrally located therein. The hole 94 is located at the back of the floor 92. Because the floor 92 is slanted or inclined downwardly towards the back and includes the circular incline towards its center, any water dripping off the bristles 32 will flow to the hole 94 for passage into a soft plastic drip tube 96 having a lower end piece 98 which extends down into a water-collection basin 100 defined within a drawer 102. The basin 100 has a drawer stop and guide arrangement 104 and a finger hold 106 to allow the basin drawer 102 to be slid out of the cradle 86. The stop and guide 104 may provide for the removal of the basin drawer 102 upon slight tilting of the drawer as commonly employed for various desk drawers.

By virtue of the contours of side walls 90R and 90L matching the periphery of the head portion 24 and the neck portion 26, the apparatus 10 will necessarily seat within the cradle 86 with the orientation shown in FIG. 3. This orientation will allow proper charging of the batteries within the apparatus 10 by application of electrical power from the recharge source 84 to the charging contacts 78P and 78N.

With particular reference to FIGS. 3, 4, and 6, the arrangement for recharging the apparatus 10 by placement upon the cradle 86 will be discussed. FIG. 6 is a simplified cross section view taken along lines 6—6 of FIG. 5. As each of the side walls 90R and 90L is essentially identical, the following discussion will relate to the connections for the right side wall 90R to electrically connect to the positive terminal 78P of the apparatus 10. The side wall 90R includes a hole 108R through which the charging contact 78P will extend when the apparatus 10 is placed upon the cradle 86. Disposed just inside of the hole 108R is a spring-biased source contact 84P which, for example, may be mounted upon a flange 110R extending inwardly from the side wall 90R. The spring source contact 84P is secured to the flange 110R by a screw 112R and has plastic pins 114R which insure that the contact 84P is biased outwardly towards the hole 108R. Upon placement of the apparatus 10 within the cradle 86, the terminals 78P and 78N will extend into the corresponding holes 108R and 108L and push outwardly against the bias of the spring source contacts 84P, thus insuring secure contact between the terminals such that the recharge source 84 may properly recharge the batteries within the apparatus 10. The placement of the source contacts 84P and 84N adjacent and within opposite side walls 90R and 90L and horizontally displaced from the floor 92 prevents any water upon the apparatus 10 from short circuiting the recharge source 84.

In addition to the cradle 86, a simpler cradle of similar construction but without the recharging arrangement and without the basin 100 may be used for holding the apparatus 10 within the shower. That is, such a simplified cradle could be mounted within the shower and used for temporarily holding the apparatus 10. Upon the person leaving the shower they would remove the apparatus 10 and place it upon the cradle 86 for recharging and to allow water to drip within basin 100 which may be removed and emptied as appropriate.

Although various specific constructions and materials have been disclosed herein, these are for illustrative purposes. Various modifications and adaptations will be apparent to those of skill in the art. For example, a simplified version of the cradle 86 might include the basin 100, but not the recharging arrangement. Alternately, a simplified version of the cradle 86 might include the recharging arrangement of the present invention but not the basin. These and other modifications may depart from the preferred embodiment, but remain within the spirit of the present invention. Accordingly, the scope of the present invention should be determined by reference to the claims appended hereto.

What is claimed is:

1. An invention comprising a personal scrub brush apparatus including:

a housing having a handle portion and a head portion;

a battery compartment for holding at least one battery within said housing;

a rotatable scrub brush having bristles thereon and mounted at said head portion;

a motor mounted in said housing, drivingly connected to rotate said scrub brush, and electrically connected to operate under the power from one or more batteries in said battery compartment; and a switch mounted on said handle portion and operable to switch power to said motor; and wherein said handle portion includes a front and a back, said front of said handle portion being closest to said brush and extending at least partially in a straight line, and wherein said scrub brush is disposed in a plane which intersects said front of said handle portion at an obtuse angle, and wherein said housing further includes a neck portion connecting said head portion to said handle portion, said neck portion having a narrower width at an end adjacent said handle portion and increasing in width closer to said head portion, said personal scrub brush apparatus including first and second charging contacts connected to said battery compartment for recharging a battery or batteries disposed therein, and said invention further comprises a recharging cradle for supporting said apparatus and having a head accommodating portion to removably receive said head portion, said apparatus being supported by said head accommodating portion, said recharging cradle having first and second source contacts connected to a recharging source and biased to contact said respective first and second charging contacts.

2. The invention of claim 1 wherein said handle portion is a handle member and said neck portion is a distinct member fastened thereto and extending along a convex back surface.

3. The invention of claim 1 wherein said switch is on said front of said handle, said battery compartment is in said handle, and said motor is in said head portion.

4. The invention of claim 3 wherein said housing further includes a shield extending peripherally around said scrub brush.

5. An invention comprising a personal scrub brush apparatus including:

a housing having a handle portion and a head portion;

a battery compartment for holding at least one battery within said housing;

a rotatable scrub brush having bristles thereon and mounted at said head portion;

a motor mounted in said housing, drivingly connected to rotate said scrub brush, and electrically connected to operate under the power from one or more batteries in said battery compartment; and a switch mounted on said handle portion and operable to switch power to said meter; and wherein said handle portion includes a front and a back, said front of said handle portion being closest to said brush and extending at least partially in a straight line, and wherein said scrub brush is disposed in a plane which intersects said from to said handle portion at an obtuse angle, and wherein said housing further includes a neck portion connecting said head portion to said handle portion, said neck portion having a narrower width at an end adjacent said handle portion and increasing in width closer to said head portion, and wherein said switch is on said front of said handle, said battery compartment is in said handle, and said motor is in said head portion, and further comprising:

first and second charging contacts mounted on opposite sides of said head portion and connected to provide recharging energy to said battery compartment for recharging a battery or batteries disposed therein; and wherein said head portion is wider than said handle portion and is adapted to seat within a recharging cradle having first and second source contacts which respectively contact said first and second charging contacts when said head portion is seated in said cradle.

6. An invention comprising a personal scrub brush apparatus including:

a housing having a handle portion and a head portion;

a battery compartment for holding at least one battery within said housing;

a rotatable scrub brush having bristles thereon and mounted at said head portion;

a motor mounted in said housing, drivingly connected to rotate said scrub brush, and electrically connected to operate under the power from one or more batteries in said battery compartment; and a switch mounted on said handle portion and operable to switch power to said motor; and first and second charging contacts mounted on opposite sides of said head portion and connected to provide recharging energy to said battery compartment for recharging a battery or batteries disposed therein; and wherein said head portion is wider than said handle portion and is adapted to seat within a recharging cradle having first and second source contacts which respectively contact said first and second charging contacts when said head portion is seated in said cradle.

7. The invention of claim 6 further comprising a charge indication light on said housing operable to light when recharging is occurring.

8. The invention of claim 6 wherein said recharging cradle has a head accommodating portion to removably receive said head portion, said head accommodating portion having first and second source contacts mounted therein and connected to a recharging source.

9. The invention of claim 8 wherein said first and second source contacts are biased to properly contact said respective first and second charging contacts.

10. The invention of claim 9 wherein said first and second source contacts each function as a leaf spring to maintain proper contact respectively with said first and second charging contacts.

11. The invention of claim 8 wherein said head accommodating portion includes a floor slanted away from said first and second charging contacts.

12. The invention of claim 8 wherein said head accommodating portion is adapted to receive said head portion with said scrub brush mounted thereon and said cradle further comprises a water collection basin disposed to receive water dripping from said scrub brush when said apparatus is in said cradle.

13. The invention of claim 8 wherein said handle portion includes a front and a back, said front of said handle portion being closest to said brush and extending in a straight line, and wherein said scrub brush is disposed in a plane which intersects said front of said handle portion at an obtuse angle, and wherein said housing further includes a neck portion connecting said head portion to said handle portion, said neck portion having a narrower width at an end adjacent said handle portion and increasing in width closer to said head portion.

14. An invention comprising a personal scrub brush apparatus including:

a housing having a handle portion and a head portion;

a battery compartment for holding at least one battery within said housing;

a rotatable scrub brush having bristles thereon and mounted at said head portion;

a motor mounted in said housing, drivingly connected to rotate said scrub brush, and electrically connected to operate under the power from one or more batteries in said battery compartment; and a switch mounted on said handle portion and operable to switch power to said motor; and said invention further comprises a cradle for supporting said apparatus and having a head accommodating portion adapted to removably receive said head portion with said scrub brush mounted thereon, said cradle further including water a collection basin disposed to receive water dripping from said scrub brush when said apparatus is in said cradle.

15. The invention of claim 14 wherein said cradle includes a back for placement against a wall and wherein said head accommodating portion has a floor portion slanted downwardly towards said back and said cradle further includes a passageway for water passage from said floor to said basin.

16. The invention of claim 15 wherein said floor portion is further slanted downwardly towards a center of said floor portion.

17. The invention of claim 15 wherein said basin is slidably mounted to said cradle.

18. The invention of claim 15 wherein said basin is movably mounted to said cradle.

19. The invention of claim 15 wherein said handle portion includes a front and a back, said front of said handle portion being closest to said brush and extending in a straight line, and wherein said scrub brush is disposed in a plane which intersects said front of said handle portion at an obtuse angle, and wherein said housing further includes a neck portion connecting said head portion having a narrower width at an end adjacent said handle portion and increasing in width closer to said head portion and wherein said handle portion extends to below said cradle when said head portion is seated in said cradle.

20. The invention of claim 15 wherein said apparatus further comprising:

first and second charging contacts mounted on opposite sides of said head portion and connected to provide recharging energy to said battery compartment for recharging a battery or batteries disposed therein; and wherein said cradle has first and second source contacts and said head portion is wider than said handle portion and is adapted to seat in said cradle with said first and second source contacts respectively contacting said first and second charging contacts when said head portion is seated in said cradle.

* * * * *